US006447107B1

(12) United States Patent
Chino et al.

(10) Patent No.: US 6,447,107 B1
(45) **Date of Patent: *Sep. 10, 2002**

(54) PRINTING HEAD AND INK JET RECORDING APPARATUS USING THE SAME

(75) Inventors: Yuji Chino; Katsuji Arakawa, both of Suwa (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/194,487

(22) PCT Filed: Mar. 25, 1998

(86) PCT No.: PCT/JP98/01322

§ 371 (c)(1),
(2), (4) Date: Nov. 23, 1998

(87) PCT Pub. No.: WO98/42513

PCT Pub. Date: Oct. 1, 1998

(30) Foreign Application Priority Data

Mar. 26, 1997 (JP) ..... 9-074207

(51) Int. Cl.[7] ..... B41J 2/045
(52) U.S. Cl. ..... 347/71; 68/70
(58) Field of Search ..... 347/71, 54, 68, 347/70

(56) References Cited

U.S. PATENT DOCUMENTS 5,194,298 A * 3/1993 Kaun ..... 427/207.1
5,734,395 A * 3/1998 Kamisuki et al. ..... 347/54

FOREIGN PATENT DOCUMENTS

| | | | |
|---|---|---|---|
| JP | 59-143650 | 8/1984 | |
| JP | 1-232057 | 9/1989 | |
| JP | 401232057 A * | 9/1989 | ..... B41J/3/04 |
| JP | 2-303847 | 12/1990 | |
| JP | 5-318734 | 12/1993 | |

* cited by examiner

*Primary Examiner*—John Barlow
*Assistant Examiner*—An H. Do
(74) *Attorney, Agent, or Firm*—Michael T. Gabrik

(57) ABSTRACT

An ink jet head which is -prevented from corrosion by ink, and an ink jet recording apparatus using the same. An ink-resistant thin film (25) made of Ti, a Ti compound, or $Al_2O_3$ is formed on the surface of recess portions (21 to 23) of a substrate in which a reservoir (8) for reserving ink, orifices (7) and pressure chambers (6) are formed. Since this ink-resistant thin film (25) is formed, corrosion can be restrained without reducing printing quality, without necessity to change the component/composition of the ink and the material of the head, and with little change of its manufacturing process, even if there is a fear that the head material may be corroded by the ink.

13 Claims, 4 Drawing Sheets

PRINTING HEAD AND INK JET RECORDING APPARATUS USING THE SAME

TECHNICAL FIELD

The present invention relates to a printing head ejecting ink drops to print (hereinafter referred to as "ink Jet head"), and an ink jet recording apparatus using the same.

BACKGROUND TECHNIQUE

Recently ink jet recording apparatuses have come into wide use with the developments of printing in high picture quality and in colors. Of those developments, first, about the development of printing in high picture quality, the improvement of nozzle density in an ink jet head played a very large part. As the result of various investigation and development therefor, silicon, glass, photosensitive dry film, ceramics, etc. as well as metal and plastic used conventionally have come into use for an ink jet head in view of easiness in fine working, accuracy in working, process etc. In addition, to realize printing in high picture quality and in colors, investigation and development have been performed also upon ink. In order to optimize permeability or coloring properties of ink in the case where ink adheres to recording paper, or in order to improve shelf stability of ink for a long term, investigation and development have been performed also upon the components and compositions of ink. As a result, printing in vivid colors have been made able without generating mixing of different color inks adjacent to each other.

Thus, printing in high picture quality and in colors have been realized. However, it is considered that the material of an ink jet head may be dissolved in ink according the combination of the ink jet head material and the ink component. In that case, the component and composition of the ink or the material of the head is generally changed.

However, the following problems are pointed out when the material of the head is changed and replaced by another material which is not dissoluble in the ink.

First, the change of the material of the ink jet head causes sacrifices in accuracy of working and in easiness of fine working. As a result, lowering of nozzle density and hence lowering of printing quality may be caused. In addition, according to the material, it becomes necessary to change the process on a large scale.

Further, the component and composition of ink are adjusted so that the permeability and coloring properties of the ink on recording paper are optimized in order to improve the printing quality. In addition, the component and composition of ink are adjusted so as to improve the shelf stability of the ink for a long term. The change of the component and composition of ink causes lowering in one or some ink properties such as ink permeability and coloring in recording paper, printing quality, and long-term shelf stability.

DISCLOSURE OF THE INVENTION

It is therefore an object of the present invention to provide an ink jet head which is not corroded by ink and an ink jet recording apparatus using such an ink jet head.

In an ink jet head according to the present invention, an ink-resistant thin film is formed at least on the surface of each of diaphragms constituting pressure chambers each for giving pressure to ink to thereby eject the ink. The diaphragm which is a bottom plate of the; pressure chamber is easily affected by corrosion because the diaphragm is extremely thin. However, by forming the ink-resistant thin film in that portion, corrosion by ink can be prevented.

In addition, in the ink jet head according to the present invention, the ink-resistant thin film is formed in recess portions of a substrate for forming an ink reservoir for reserving the ink, orifices for guiding the ink from the ink reservoir into the pressure chambers, and the pressure chambers. The substrate is comparatively thin, so that the influence of corrosion on the substrate is large. However, corrosion by ink can be avoided by forming the ink-resistant thin film in the recess portions forming the ink reservoir, the orifices and the pressure chambers.

In addition, the ink-resistant thin film consists of Ti, a Ti compound, or $Al_2O_3$. The Ti compound consists of nitride or oxide. It has been confirmed that these ink-resistant thin films do not change even if the films contact with ink, and corrosion by ink can be avoided in the portion where the thin film is formed.

In addition, in an ink jet recording apparatus according to the present invention, any one of the abovementioned ink jet heads is attached thereto.

According to the present invention, therefore, even if the material of an ink jet head might be corroded by ink, it is not necessary to change the material of the ink jet head and the component and composition of the ink. In addition, the corrosion by ink can be prevented while avoiding lowering of printing quantity or a drastic change of the process due to the aforementioned change in the material of the ink jet head and in the component and composition of the ink.

BRIEF DESCRIPTION OF THE INVENTION

THE BEST MODE FOR CARRYING OUT THE INVENTION

Embodiment 1

Figure 1:
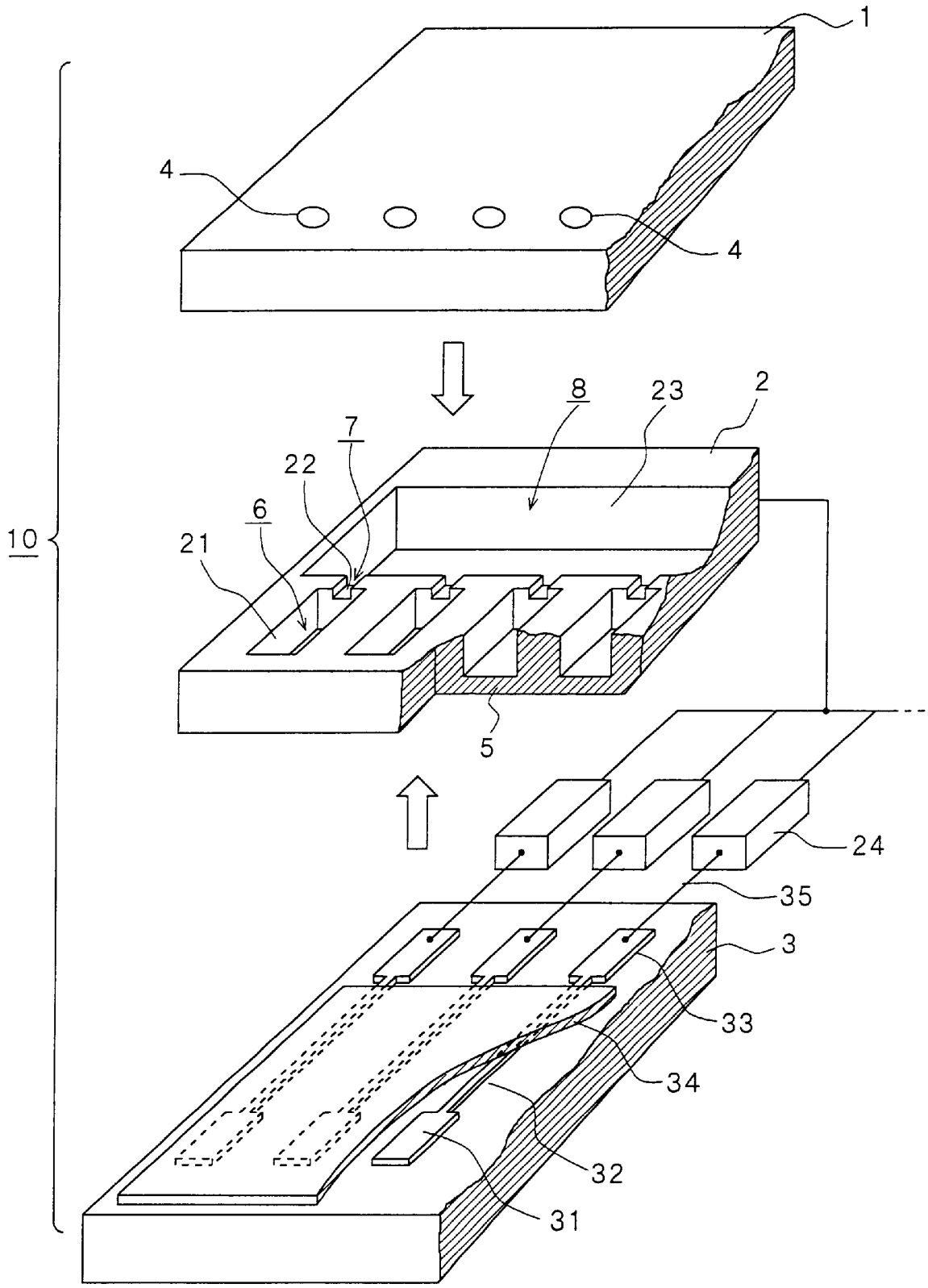
FIG. 1 is an exploded perspective view of respective parts of an ink jet head (electrostatic system) according to Embodiment 1 of the present invention.
Figure 2:
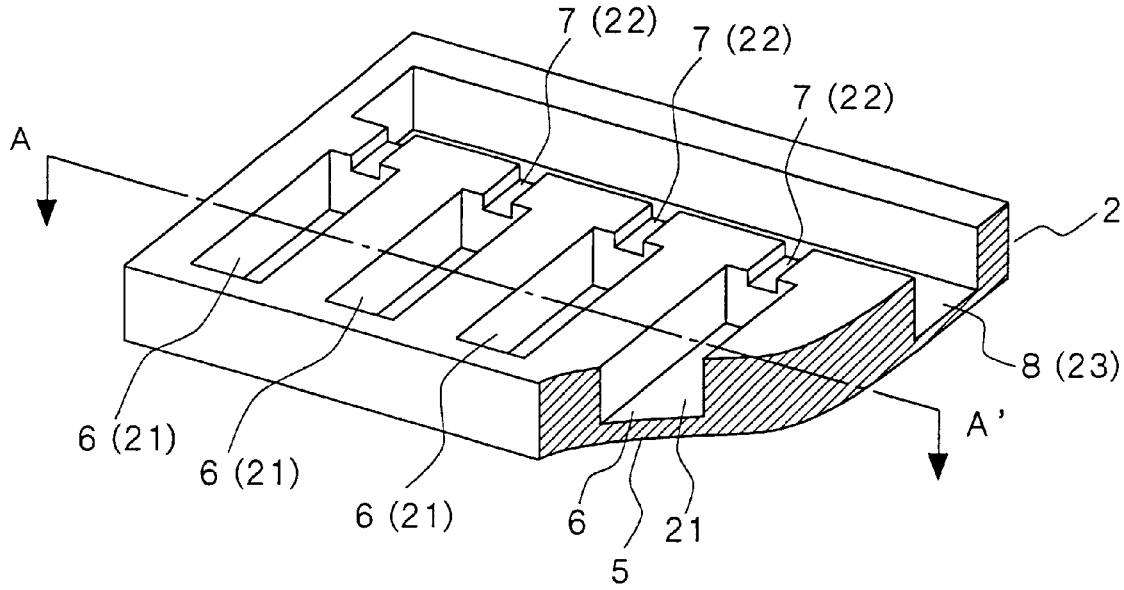
FIG. 2 is a perspective view of an intermediate substrate extracted from the ink jet head in FIG. 1.

A driving method of an electrostatic system is adopted in an ink jet head 10 according to this embodiment. The ink jet head has a lamination structure in which three substrates 1, 2 and 3 having a structure which will be described in detail later are laminated one on another and bonded with each other, as shown in FIGS. 1 and 2. The upper substrate 1 made of, for example, silicon, glass or plastic is provided with a plurality of nozzle holes 4 (the pitch is about 70 $\mu$m, and the diameter is about 25 $\mu$m) so as to form a nozzle plate. The intermediate substrate 2 is constituted by, for example, a silicon single-crystal substrate. The intermediate substrate 2 has recess portions 21 communicating with the nozzle holes 4 and constituting pressure chambers 6 with their bottom walls acting as diaphragms 5; narrow grooves 22 provided at the rear of the recess portions 21 so as to constitute orifices 7 acting as ink inlets; and a recess portion 23 constituting a common reservoir 8 for feeding ink to the respective pressure chambers 6.

This intermediate substrate 2 is bonded with the upper substrate 1 so as to constitute the pressure chambers 6, the orifices 7 and the reservoir 8, and forms a flow path unit together with the upper substrate 1. Ink from an ink tank is supplied to the reservoir 8 through a connection pipe, a tube, or the like. The reservoir 8 and the pressure chambers 6 are filled with the ink.

The lower substrate 3 is made of, for example, glass or plastic and bonded with the lower surface of the intermediate substrate 2. The lower substrate 3 is provided with electrodes 31 formed on the surface of the lower substrate 3 in the positions respectively corresponding to the above-mentioned diaphragms 5. Each of the electrodes 31 has a lead portion 32 and a terminal portion 33. Further, all of the electrodes 31 and the lead portions 32 except the terminal portions 33 are coated with an insulating film 34. Lead wires 35 are bonded with the terminal portions 33, respectively.

The above-mentioned substrates 1, 2 and 3 are bonded with one another so as to be assembled. Further, vibrating circuits 24 are connected between the intermediate substrate 2 and the terminal portions 33 of the electrodes 31 respectively to thereby constitute the ink jet head 10.

Next, the operation of the ink jet head 10 in FIG. 1 will be described. When a pulse voltage in a range of, for example, from 0V to a some positive value is applied to an electrode 31 by, the corresponding vibrating circuit 24, the surface of the electrode 31 is electrified to a positive potential, and the lower surface of the diaphragm 5 corresponding to the electrode 31 is electrified to a negative potential. Therefore, the diaphragm 5 is bent downward by the attraction action of static electricity. Then, when the pulse voltage to the electrode 31 is turned OFF, the diaphragm 5 is restored. Therefore, the pressure in the pressure chamber 6 increases suddenly so as to eject an ink drop toward recording paper from the nozzle hole 4. The diaphragm 5 is bent downward, so that ink is supplied into the corresponding pressure chamber 6 from the ink reservoir 8 through the corresponding orifice 7. As the vibrating circuit 24, a circuit for performing turning ON/OFF of the voltage in the range of from 0V to a some positive value as mentioned above, an AC power source, or the like, may be used. In recording, it will go well if electric pulses to be applied to the electrodes 31 of the respective nozzle holes 4 are controlled.

Next, detailed description will be made about the intermediate substrate 2 which is a feature of this embodiment. In the intermediate substrate 2, Ti is laminated to form an ink-resistant thin film 25 by any one of a sputtering method, a vacuum deposition method, an ion plating method, and a CVD method, on the surface of the portion where ink flows (hereinafter referred to as "ink flow path"), that is, the recess portions 21 to 23 forming the orifices 7 and the reservoirs 8, including the pressure chambers 6. As for the dimensions of the respective portions at this time, the depth a of the pressure chambers 6 (recess portions 21) is 60 $\mu$m, the width b of the pressure chambers 6 (recess portions 21) is 50 $\mu$m, and the width c of pressure chamber partitions 26 is 20 $\mu$m. Surfaces 27 of the pressure chamber partitions 26 of the intermediate substrate 2, on which the upper substrate 1 is to be pasted, do not come into direct contact with ink. Therefore, even if an ink-resistant thin film is not formed on the surfaces 27 by use of any means, there is no fear that the effect of this embodiment is reduced.

Although the ink-resistant thin film 25 is laminated so that the film thickness thereof is 1,000 Å on the surface of the diaphragm 5 (the size d in FIG. 3), the Ti film thickness on each surface 27 (the size e in FIG. 3) at that time varies in accordance with the laminating method used therefor, as shown in the following Table 1.

TABLE 1

| laminating method | ink-resistant thin film thickness on the surface contacting with the nozzle plate |
|---|---|
| sputtering | 8,000 Å |
| vacuum deposition | 10,000 Å |
| ion plating | 6,500 Å |
| CVD | 5,000 Å |

Figure 3:
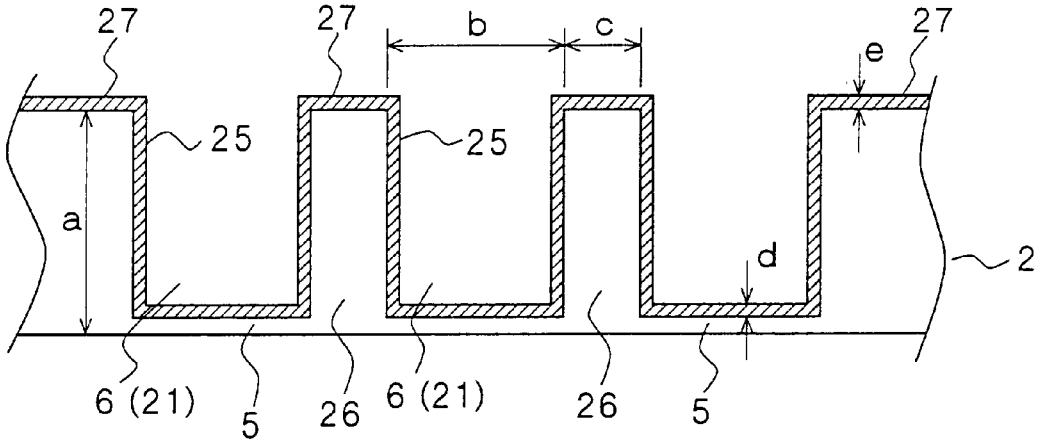
FIG. 3 is a sectional view taken on line A—A in FIG. 2.

Table 1 shows the film thickness on the surfaces 27 contacting with the upper substrate 1 (nozzle plate) when the film thickness is 1,000 Å on the surface of the diaphragm 5. However, it is difficult to measure the film thickness on the surface of the diaphragm 5 (it is difficult to measure the film thickness in recess portions as shown in FIG. 3). In addition, the film thickness on the surfaces of the diaphragm 5 has a univocal relationship with the film thickness on the surfaces 27. Therefore, the characteristic of the film thickness on the surfaces 27 shown in Table 1 is used for grasping the film thickness on the surfaces of the diaphragm 5. This fact applies to the embodiments which will be described later.

Embodiment 2

In this embodiment, titanium nitride (hereinafter referred to as "TiN") is laminated all over the surface of an ink flow path (recess portions 21 to 23 constituting pressure chambers 6, orifices 7 and a reservoir 8) of an intermediate substrate 2 having the same shape as that in Embodiment 1, by any one of a sputtering method, a vacuum deposition method, an ion plating method, and a CVD method so as to form an ink-resistant thin film. The thin film has the same sectional shape as that in the above-mentioned Embodiment 1, as shown in FIG. 3.

Although TiN is laminated so that the film thickness thereof is 1,000 Å on the surface of the diaphragm 5 (the size d in FIG. 3), the TiN film thickness on each surface 27 (the size e in FIG. 3) at that time varies in accordance with the laminating method used therefor, as shown in the following Table 2.

TABLE 2

| laminating method | ink-resistant thin film thickness on the surface contacting with the nozzle plate |
|---|---|
| sputtering | 7,500 Å |
| vacuum deposition | 9,000 Å |
| ion plating | 6,000 Å |
| CVD | 4,500 Å |

Embodiment 3

In this embodiment, titanium oxide (hereinafter referred to as "$TiO_2$") is laminated all over the surface of an ink flow path (recess portions 21 to 23 constituting pressure chambers 6, orifices 7 and a reservoir 8) of an intermediate substrate 2 having the same shape as that in Embodiment 1, by any of sputtering, vacuum deposition, ion plating, and CVD, so as to form an ink-resistant thin film. The thin film has a sectional shape as shown in FIG. 3, in the same manner as that in the above-mentioned Embodiment 1.

Although $TiO_2$ is laminated so that the film thickness thereof is 1,000 Å on the surface of the diaphragm 5 (the size d in FIG. 3), the $TiO_2$ film thickness on the surfaces 27 (the size e in: FIG. 3) at that time varies in accordance with a laminating method used therefor, as shown in the following Table 3.

TABLE 3

| laminating method | ink-resistant thin film thickness on the surface contacting with the nozzle plate |
|---|---|
| sputtering | 8,500 Å |
| Vacuum deposition | 11,000 Å |
| ion plating | 7,000 Å |
| CVD | 5,500 Å |

Embodiment 4

In this embodiment, $Al_2O_3$ is laminated all over the surface of an ink flow path (recess portions 21 to 23, constituting pressure chambers 6, orifices 7 and a reservoir 8) of an intermediate substrate 2 having the same shape as that in Embodiment 1, by any of sputtering, vacuum deposition, ion plating, and CVD, so as to form an ink-resistant thin film. The thin film has a sectional shape as shown in FIG. 3, in the same manner as that in the above-mentioned Embodiment 1.

Although $Al_2O_3$ is laminated so that the film thickness thereof is 1,000 Å on the surface of the diaphragm 5 (the size d in FIG. 3), the $Al_2O_3$ film thickness on the surfaces 27 (the size e in FIG. 3) at that time varies in accordance with a laminating method used therefor, as shown in the following Table 4.

TABLE 4

| laminating method | ink-resistant thin film thickness on the surface contacting with the nozzle plate |
|---|---|
| sputtering | 9,000 Å |
| vacuum deposition | 12,500 Å |
| ion plating | 7,800 Å |
| CVD | 6,000 Å |

(Evaluation Test 1)

Tables 5 and 6 show the results of evaluation which was made about ink-resistance of ink-resistant thin films thus formed on the surface of silicon ink flow paths in Embodiments 1 to 4.

Evaluation items at this time were the amount of change in film thickness of the ink-resistant thin films, and the presence of pin-holes and corrosion. The method of the evaluation was as follows. The silicon ink flow paths on which the ink-resistant thin films were formed were immersed in amine-containing organic pigment ink and 1% KOH water-solution at 70° C. for 7 days. After that, the amount of change in film thickness of the ink-resistant thin films was measured, and the presence of pin-holes :in the ink-resistant thin films and the presence of corrosion in the silicon ink flow paths were confirmed. For comparison, also a silicon ink flow path without any ink-resistant thin film was immersed in ink, and a change of the external appearance of the silicon ink flow path was observed. During the immersion test, the surface of the diaphragm 5 on the electrode substrate side (back side) was prevented from touching the ink and the KOH water-solution directly.

TABLE 5

| thin film material | laminating method | ink-resistant thin film thickness after immersion change amount unit: Å ink | 1% KOH |
|---|---|---|---|
| metal Ti | sputtering | 0 | 0 |
| | vacuum deposition | 0 | 0 |
| | ion plating | 0 | 0 |
| | CVD | 0 | 0 |
| TiN | sputtering | 0 | 0 |
| | vacuum deposition | 0 | 0 |
| | ion plating | 0 | 0 |
| | CVD | 0 | 0 |
| $TiO_2$ | sputtering | 0 | 0 |
| | vacuum deposition | 0 | 0 |
| | ion plating | 0 | 0 |
| | CVD | 0 | 0 |
| $Al_2O_3$ | sputterig | 0 | 0 |
| | vacuum deposition | 0 | 0 |
| | ion plating | 0 | 0 |
| | CVD | 0 | 0 |
| $SiO_2$ | thermal oxidation *1 | *3 | *3 |
| SiN | low-pressure CVD *2 | *3 | *3 |
| Nothing | — | — | — |

*1 Thin film thickness on the surface contacting with the nozzle plate was 1,000 Å.
*2 Thin film thickness on the surface contacting with the nozzle plate was 5,000 Å.
*3 The thin film hardly remained after immersion.

TABLE 6

| thin film material | laminating method | ink: pin-holes: ○ absence: X presence | ink: corrosion: ○ absence: X presence | 1% KOH: pin-holes: ○ absence: X presence | 1% KOH: corrosion: ○ absence: X presence |
|---|---|---|---|---|---|
| metal Ti | sputtering | ○ | ○ | ○ | ○ |
| | vacuum deposition | ○ | ○ | ○ | ○ |
| | ion plating | ○ | ○ | ○ | ○ |
| | CVD | ○ | ○ | ○ | ○ |
| TiN | sputtering | ○ | ○ | ○ | ○ |
| | vacuum deposition | ○ | ○ | ○ | ○ |
| | ion plating | ○ | ○ | ○ | ○ |
| | CVD | ○ | ○ | ○ | ○ |
| $TiO_2$ | sputtering | ○ | ○ | ○ | ○ |
| | vacuum deposition | ○ | ○ | ○ | ○ |
| | ion plating | ○ | ○ | ○ | ○ |
| | CVD | ○ | ○ | ○ | ○ |
| $Al_2O_3$ | sputtering | ○ | ○ | ○ | ○ |
| | vacuum deposition | ○ | ○ | ○ | ○ |
| | ion plating | ○ | ○ | ○ | ○ |
| | CVD | ○ | ○ | ○ | ○ |
| $SiO_2$ | thermal oxidation *1 | *3 | *3 | | |
| SiN | low-pressure CVD *2 | *3 | *3 | | |
| Nothing | — | — | — | | |

*1 Thin film thickness on the surface contacting with the nozzle plate was 1,000 Å.
*2 Thin film thickness on the surface contacting with the nozzle plate was 5,000 Å.
*3 The thin film hardly remained after immersion.

First, in any case where the thin film material was metal Ti, TiN, $TiO_2$ or $Al_2O_3$, no change was observed in the film thickness of the ink-resistant thin film before and after the ink immersion. In addition, the presence of pin-holes was checked with a metallographical microscope, an electron microscope, etc. after the ink immersion, but no pin-hole was observed. Further, the presence of corroded places was checked in the diaphragm with a metallographical microscope, an electron microscope, etc. after removing the ink-resistant thin film, but no corroded place was observed. On the other hand, in the case of the silicon ink flow path ($SiO_2$ or SiN) without any ink-resistant thin film, the material was corroded in either case where it was immersed in ink or KOH, and the thin film hardly remained after the immersion.

(Evaluation Test 2)

In addition, making the: above-mentioned conditions (immersion at 70° C. and for 7 days) severer, hard evaluation (immersion at 80° C. and for 30 days) was made. This time, deterioration was recognized upon the thin film of $Al_2O_3$. However, even under such conditions, deterioration was not recognized upon the thin films of metal Ti, TiN and $TiO_2$ at all. Therefore, of these four kinds of thin films, it was proved that the thin films of metal Ti, TiN and $TiO_2$ are more preferable.

Embodiment 5

Figure 4:
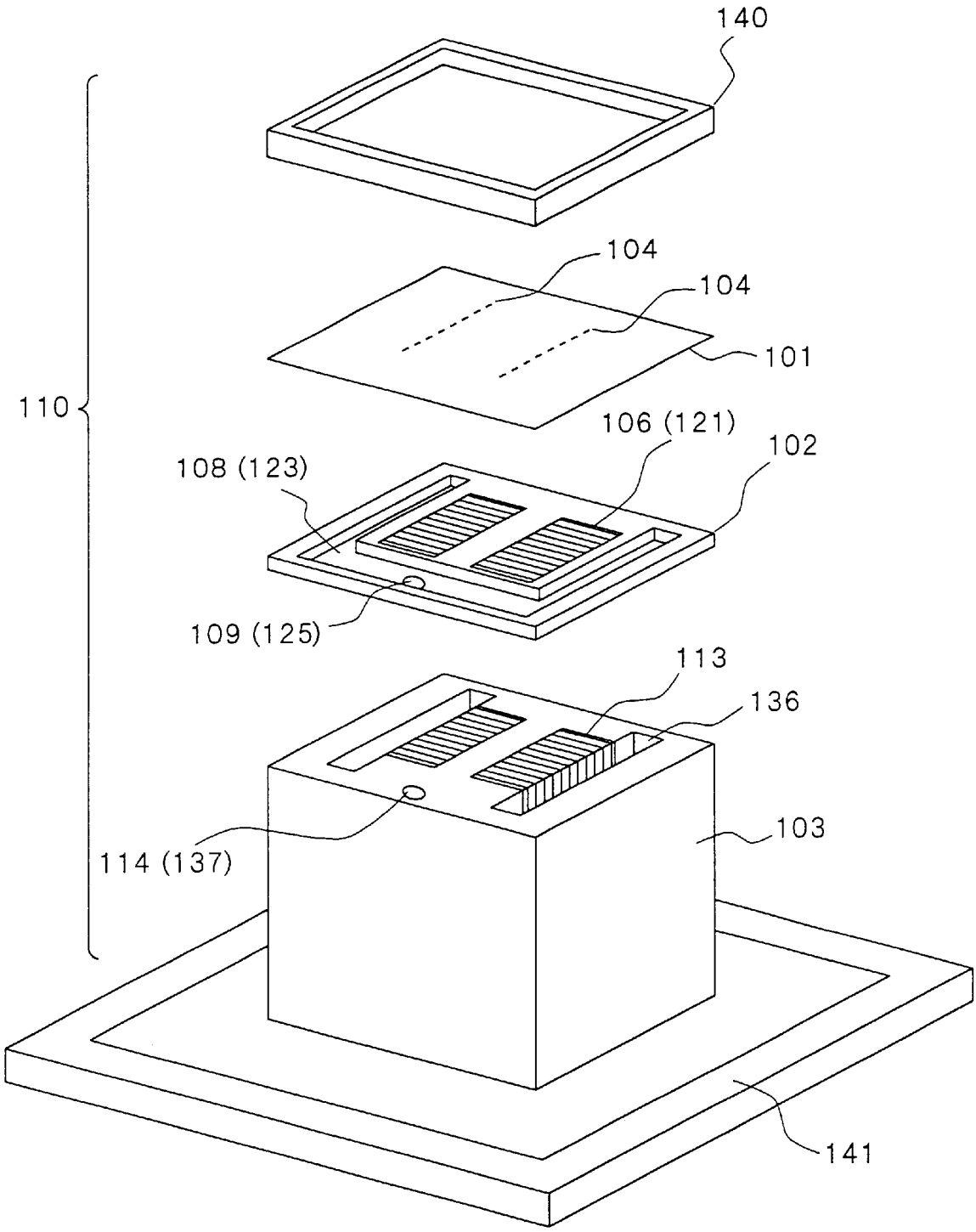
FIG. 4 is an exploded perspective view of respective parts of an ink jet head (piezo-electric system) according to Embodiment 5 of the present invention.

In an ink jet head 110 according to this embodiment, a driving method of a piezo-electric system is adopted. The ink jet head 110 has a lamination structure in which three substrates 101, 102, and 103 having a structure which will be described in detail later are laminated one on another and bonded with one another, as shown in FIG. 4. The upper substrate 101 is provided with a large number of nozzle holes 104 (an example in which two lines of nozzle holes are arranged is illustrated in FIG. 4) so as to form a nozzle plate.

The intermediate substrate 102 is constituted by, for example, a silicon single-crystal substrate. The intermediate substrate 102 is provided with recess portions 121 constituting pressure chambers 106 with their bottom plates acting as diaphragms; recess portions (not shown in detail) provided at the rear of the recess portions 121 so as to constitute orifices for feeding ink to the pressure chambers 106; a recess portion 123 constituting a reservoir 108 for feeding ink to the respective pressure chambers 106; and a hole 125 provided in this recess portion 123 so as to constitute an ink supply port 109 supplied with ink from an ink supply line 114 of the lower substrate 103, which will be described later, to thereby reserve the ink in the reservoir 108. This intermediate substrate 102 is bonded with the upper substrate 101 so as to constitute the pressure chambers 106, the orifices and the reservoir 108, and forms a flow path unit together with the upper substrate 1.

The lower substrate 103 has recess portions 136 each for storing an vibrator unit 113, and a hole 137 constituting the ink supply line 114 connected to an ink tank (not shown). The vibrator unit 113 is stored and fixed in the recess portion 136. In addition, the flow path unit (the substrates 101 and 102) is fixed to this lower substrate 103 by a frame 140 so as to constitute the ink jet head 110. The ink jet head 110 is fixed to a carriage 50 (see FIG. 5) through a substrate 141.

In the thus configured ink jet recording apparatus in this embodiment, superior effects the same as those in Embodiments 1 to 4 can be obtained by forming a thin film of metal Ti, TiN, $TiO_2$, or $Al_2O_3$ all over the surface of an ink flow path (these recess portions 121 and 123 constituting the pressure chambers 106, the orifices and the reservoir 108) of the intermediate substrate 102 by any one of a sputtering method, a vacuum deposition method, an ion plating method, and a CVD method.

Embodiment 6

Figure 5:
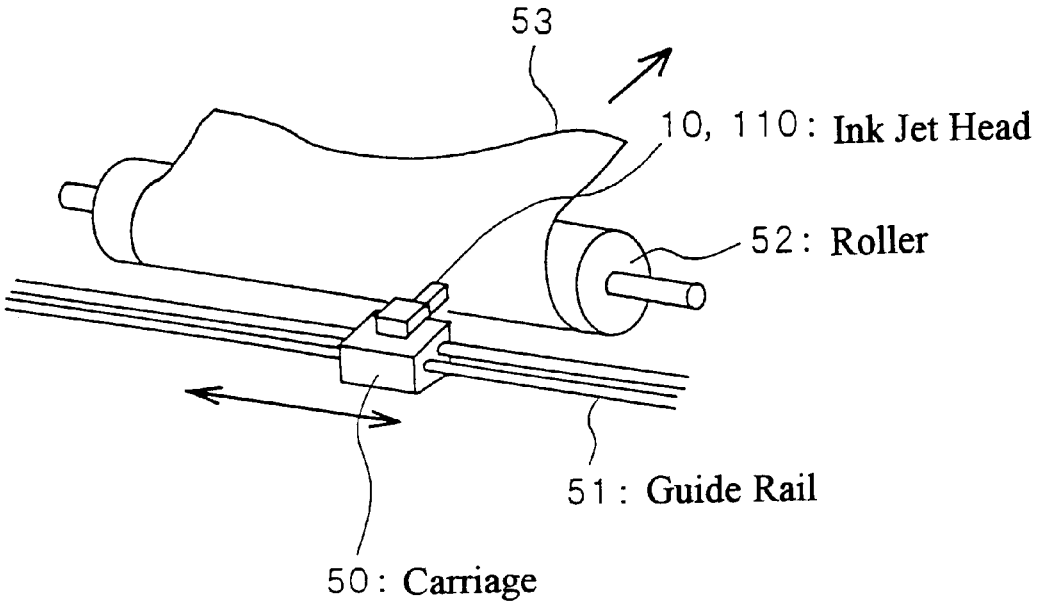
FIG. 5 is an explanatory view showing a mechanism around the ink jet head in FIG. 1 or FIG. 4.
Figure 6:
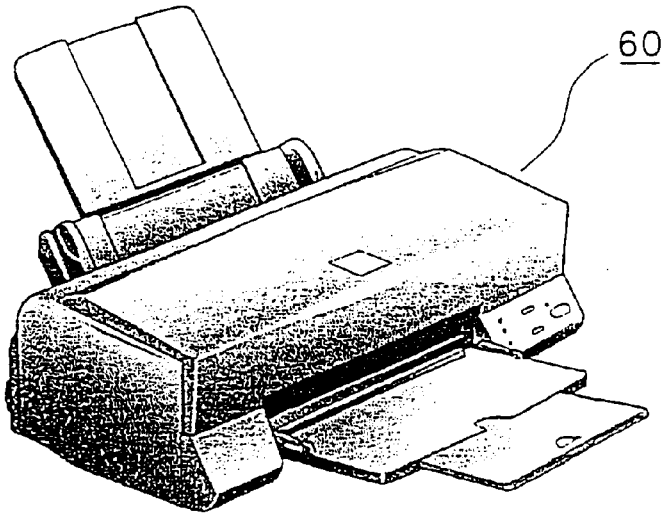
FIG. 6 is an external appearance view of an ink jet recording apparatus having the mechanism of FIG. 5 contained therein.

An ink jet head 10 or 110 shown in FIG. 1 or 4 is attached to a carriage 50 as shown in FIG. 5. This carriage 50 is attached to a guide rail 51 movably, and its position is controlled in the widthwise direction of paper 53 fed out by a roller 52. This mechanism in FIG. 5 is mounted on an ink jet recording apparatus 60 shown in FIG. 6.

The above-mentioned Embodiments 1 to 6 are merely examples of the present invention. For example, thickness of an ink-resistant thin film at a place contacting with ink directly, and thickness of the ink-resistant thin film at a place not-contacting with ink directly are not limited to the above-mentioned numerical examples, but may be changed. desirably in accordance with necessity. Materials forming the ink jet head, particularly the ink flow path unit, are not limited to the silicon single-crystal substrate, but may be metal, resin, etc., so long as no pin-hole is provided and an ink-resistant protective film can be formed.

In addition, in the above-mentioned Embodiments 1 to 5, although description was made about examples in which an ink-resistant thin film is formed all over the surface of an ink flow path, it is not always necessary to form an ink-resistant thin film all over the surface of an ink flow path. A conspicuous effect can be obtained if an ink-resistant thin film is formed at least on a diaphragm. The diaphragm of the ink jet head is extremely thin, and is apt to be subjected to influence of dissolution by ink. Accordingly, if an ink-resistant thin film is formed at least on the diaphragm, it is possible to prevent corrosion by ink effectively.

In addition, although amine-containing organic pigment ink was used as the ink in the above-mentioned Embodiments 1 to 5, the effects of the present invention is not reduced even if another pigment ink or dye ink is used.

We claim:

1. An ink jet head including a substrate defining pressure chambers for containing ink, said pressure chambers being divided by partitions each of which has a first surface, each of said pressure chambers having a deformable diaphragm capable of altering the volume of that pressure chamber for ejecting ink, each of said diaphragms having a second surface, wherein said substrate is made of silicon and said partitions and diaphragms of said pressure chambers are formed as part of the substrate, and wherein an ink-resistant thin film is formed on the surfaces of said partitions and diaphragms of said pressure chambers.

2. An ink jet head according to claim 1, wherein said ink-resistant thin film is formed in recess portions of said substrate for forming an ink reservoir for reserving ink, in orifices for guiding ink from said ink reservoir into said pressure chambers, and in said pressure chambers.

3. An ink jet head according to claim 1, wherein said ink-resistant thin film is comprised of Ti.

4. An ink jet head according to claim 1, wherein said ink-resistant thin film is comprised of a Ti compound.

5. An ink jet head according to claim 4, wherein said Ti compound is comprised of nitride or oxide.

6. An ink jet head according to claim 1, wherein said ink-resistant thin film is comprised of $Al_2O_3$.

7. An ink jet head according to claim 1, wherein said pressure chambers are each of the type that ejects ink by electrostatic force.

8. An ink jet head according to claim 1, wherein each of said diaphragms is comprised of Si.

9. An ink jet head according to claim 1, wherein. each of said diaphragms is in contact with ink.

10. An ink jet head according to claim 1, wherein said ink-resistant thin film does not constitute an electrode.

11. An ink jet head according to claim 1, wherein said partitions and diaphragms of said pressure chambers are made of the same material.

12. An ink jet recording apparatus, comprising:

an ink jet head attached to the ink jet recording apparatus and including a substrate defining pressure chambers for containing ink, said pressure chambers being divided by partitions each of which has a first surface, each of said pressure chambers having a deformable diaphragm capable of altering the volume of that pressure chamber for ejecting ink, each of said diaphragms having a second surface, wherein said substrate is made of silicon and said partitions and diaphragms of said pressure chambers are formed as part of the substrate, and wherein an ink-resistant thin film is formed on the surfaces of said partitions and diaphragms of said pressure chambers.

13. An ink jet recording apparatus according to claim 12, wherein said partitions and diaphragms of said pressure chambers are made of the same material.

* * * * *